US005107570A

United States Patent [19]

Feith

[11] Patent Number: 5,107,570

[45] Date of Patent: Apr. 28, 1992

[54] INTERMEDIATE BEARING FOR DOOR OR WINDOW

[75] Inventor: Roland Feith, Petit-Rederching, France

[73] Assignee: Ferco International Usine de Ferrures de Batiment, Sarrebourg, France

[21] Appl. No.: 543,366

[22] Filed: Jun. 26, 1990

[30] Foreign Application Priority Data

Jul. 7, 1989 [FR] France ..... 89 09362

[51] Int. Cl.[5] ..... E05D 7/10; E05D 7/12; E05C 19/00

[52] U.S. Cl. ..... 16/261; 16/272; 16/DIG. 34; 292/304

[58] Field of Search ..... 16/261, 267, 270, 271, 16/272, DIG. 34; 292/304

[56] References Cited

U.S. PATENT DOCUMENTS

| | | | |
|---|---|---|---|
| 1,249,700 | 12/1917 | Way | 16/246 |
| 1,336,174 | 4/1920 | Way | 16/DIG. 34 |
| 3,788,689 | 1/1974 | Lloyd | 292/304 |
| 4,131,970 | 1/1979 | Le Van | 16/270 |

FOREIGN PATENT DOCUMENTS

| | | |
|---|---|---|
| 2459864 | 1/1981 | France . |
| 2562136 | 10/1985 | France . |

OTHER PUBLICATIONS

German Abstract of Application No. DE-U-8 433,218.

*Primary Examiner*—Robert L. Spruill
*Assistant Examiner*—Carmine Cuda
*Attorney, Agent, or Firm*—Sandler, Greenblum & Bernstein

[57] ABSTRACT

Intermediate bearing, for a door, window, or the like, having at least a leaf pivoting about a vertical spindle, is provided with a fixed base integral with the sash-frame, and a movable element inserted at the level of the leaf. The fixed base is provided with an opening into which engages a catching pin of the movable member. This intermediate bearing additionally includes an adjustable articulation mechanism to change, perpendicularly to the stile of the sash-frame, the catching area between the movable member and the fixed base, in order to adjust the compression force exerted onto the seal arranged in the fillister of the sash-frame of the door, window or the like.

22 Claims, 1 Drawing Sheet

INTERMEDIATE BEARING FOR DOOR OR WINDOW

BACKGROUND OF THE INVENTION

1. Field of the Invention

The invention relates to an intermediate bearing for a door, window or the like having at least a leaf pivoting about a vertical spindle and comprising a fixed base integral with the sash-frame and provided with an opening into which engages a catching pin of a movable member integral with the leaf.

2. Discussion of Background and Material Information

Some doors, windows or the like comprise leafs pivoting about a vertical spindle the height of which is larger than the normal height. In some cases, as, e.g., in case of the absence of a peripheral hinge, for single leafs pivoting about a vertical spindle, it is necessary to ensure a homogeneous compression of the seal on the periphery of the fillister of the sash-frame. For this purpose, intermediate bearings have been designed which are arranged between the upper joint and the lower joint.

Thus, an intermediate bearing is known comprising a fixed base integral with the sash-frame, provided with an opening into which engages a catching pin of a movable member integral with the leaf. The upper and lower edges of this opening keep this catching pin vertical, while the vertical edge has a curvilinear wall acting as guiding means for said catching pin during the opening or the closing of the leaf. Furthermore, this bearing comprises a shim arranged between the fixed base and the movable member, in order to impart to both these components a determined positioning, with a view to facilitate the mounting of this intermediate bearing onto the sash-frame and onto the leaf, the shim is pulled away after mounting.

Now, it frequently happens that, for any reason whatsoever, the sash-frame or the leaf are slightly curved. Therefore, either the catching pin is subjected to an important friction during its movement in the opening of the fixed base or there is brought about some backlash between the catching pin and the opening and the homogeneous compression of the seal on the periphery of the fillister of the sash-frame is no longer ensured.

SUMMARY OF THE INVENTION

The object of this invention is to cope with the above-discussed disadvantages. For this purpose, the invention relates to an intermediate bearing for a door, window or the like having at least a leaf pivoting about a vertical spindle and comprising a fixed base integral with the sash-frame and provided with an opening into which engages a catching pin of a movable member integral with the leaf, this bearing comprising adjustable articulation means to modify, perpendicularly to the stile of the sash-frame, the catching area between the movable member and the fixed base.

The advantages of this invention mainly reside in it being possible to change the position of the joint, and thus to be able to adjust the compression force exerted onto the seal arranged on the periphery of the fillister of the sash-frame in order to ensure the tightness between the sash-frame and the leaf or leaves.

BRIEF DESCRIPTION OF THE DRAWINGS

The invention will be well understood by reverting to the following description which is given as a non-exhaustive example and to the attached drawing, in which.

DETAILED DESCRIPTION OF THE PREFERRED EMBODIMENTS

Figure 1:
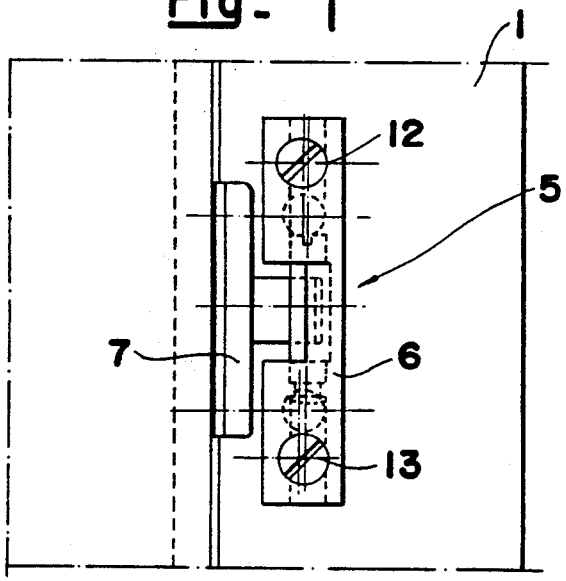
FIG. 1 is an elevation view of an intermediate bearing according to the invention, arranged between the sash-frame and the leaf of a door, window or the like, the leaf of which pivots about a vertical spindle.
Figure 2:
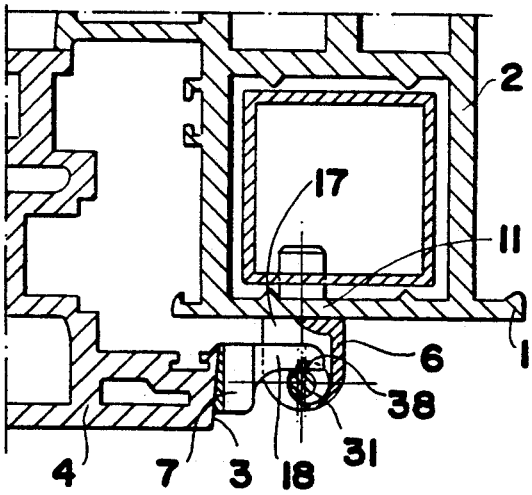
FIG. 2 is a bird's eye view of the intermediate bearing according to the invention.

As is illustrated in FIGS. 1 and 2, there is arranged, between the stile 1 of the sash-frame 2 and the stile 3 of the leaf 4 of a door, window or the like, the leaf 4 of which, in particular, has a height larger than the normal height and pivots about a vertical spindle, an intermediate bearing 5. This intermediate bearing 5 is comprised of a fixed base 6 integral with the sash-frame 2 and a movable member 7 integral with the leaf 4. In order to ensure the tightness of the door, window or the like, it is necessary to exert a homogeneous compression on the sealing (not shown) arranged on the periphery of the fillister of the sash-frame 2.

Figure 3:
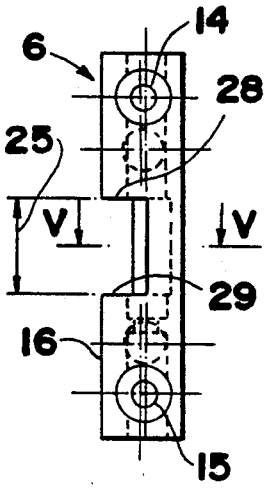
FIG. 3 is an elevation view of the fixed base.
Figure 4:
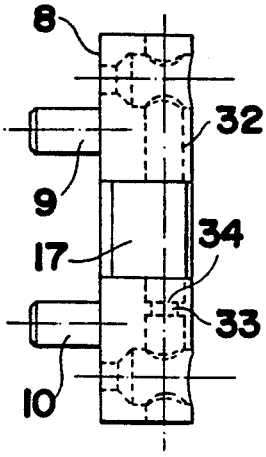
FIG. 4 is a left-hand view of the fixed base.
Figure 5:
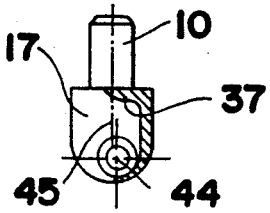
FIG. 5 is a cross-sectional view according to line V—V of FIG. 3.

Reference is made to FIGS. 3 through 5 showing various views of the fixed base 6. This fixed base comprises, on its face 8 applied onto the sash-frame 2, two positioning studs 9, 10 for insertion into openings 11 (see FIG. 2) provided in the sash-frame 2.

The fixed base 6 is made integral with the sash-frame 2 by means of fastening members 12, 13 (see FIG. 1) passing through openings 14, 15 provided for in this fixed base 6. The fixed base 6 has, on one of its vertical edges 16, a horizontal opening 17 serving as a recess for a catching pin 18 of the movable member 7. This movable member 7, shown in FIGS. 6 through 8, comprises a vertical base 19 into which are drilled two holes 20, 21 for the passing-through of fastening members (not shown) ensuring the fastening of the movable member 7 onto the leaf 4. The catching pin 18 projects with respect to the front face 22 of the vertical base 19 and is flush with one of the longitudinal edges 23 of same. The height 24 of the catching pin 18 depends on the height 25 (see FIG. 3) of the horizontal opening 17 of the fixed base 6, to ensure a co-operation between the upper edges 26 and lower edges 27 of the catching pin 18 and the upper walls 28 and lower walls 29 of the horizontal opening 17 for keeping vertical the leaf 4.

The catching pin 18 forms one of the articulation means through its active face 30 co-operating with another articulation means being part of the fixed base 6.

Figure 9:
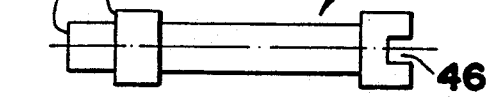
FIG. 9 is an elevation view of one of the joint-adjusting means.
Figure 11:
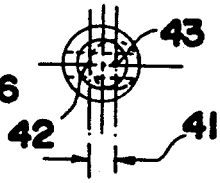
FIG. 11 is a top view of the adjusting means according to FIG. 9.
Figure 10:
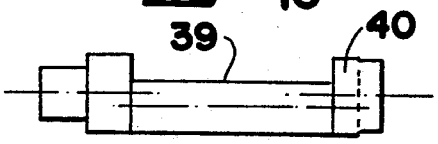
FIG. 10 is a left-hand view of said adjusting means.

According to a first embodiment, this second articulation means is an articulation spindle 31 (see FIGS. 9 through 11) which may be housed in a vertical bore 32 (see FIG. 4) provided for in the fixed base 6. This vertical bore 32 ends in a narrowed bore 33 having a shoulder 34. This shoulder 34 serves as a bearing face for an enlargement 35 provided for in the proximity of one of the ends 36 of the articulation spindle 31 and allows the rotation of same. Furthermore, this shoulder 34 not only limits the penetration of the articulation spindle 31 into the vertical bore 32, but also acts as a first means for keeping vertical said articulation spindle 31, the second means being formed by the fastening member 12 impeding the articulation spindle 31 from escaping upwardly out of the vertical bore 32.

According to a second embodiment, the second articulation means may be formed by a vertical thrust housed in the horizontal opening 17 in the fixed base 6, this vertical thrust being arranged parallelly to the return 37 of the horizontal opening 17. The inner face of this vertical thrust, i.e. the face oriented towards the return 37, serves as a bearing area for the active face 30 of the catching pin 18 of the movable member 7.

According to the invention, the intermediate bearing 5 includes adjusting means that allow to bring the catching area 38 (see FIG. 2) of the stile 1 close to, but mainly to separate it from, the sash-frame 2, which allows to adjust the compression force exerted onto the peripheral seal arranged in the fillister of the sash-frame 2, to achieve the tightness of the door, window or the like.

According to a first embodiment, the articulation spindle 31 comprises an eccentric 39 arranged between the enlargement 35 and a head 40 located at the other end of the articulation spindle. This eccentric 39, projecting into the opening 17 in the fixed base 6, serves as bearing area for the active face 30 of the catching pin 18 of the movable member 7. The distance 41 between both outermost positions 42, 43 of the eccentric 39, after rotation by 180 degrees, forms the adjustment amplitude. Furthermore, the drilling axis 44 of the vertical bore 32 and the narrowed bore 33 is off-center with respect to the median plane 45 of the fixed base. In order to rotatingly actuate the articulation spindle 31, the head 40 of the same is provided with seizing means 46 adapted to a setting tool. Thus, these seizing means 46 may be a slot into which can be inserted the end of a screw driver.

According to a second method of adjustment, the thrust arranged in the horizontal opening 17 is a thrust movable perpendicularly to the stile 1 of the leaf 2. Advantageously, this movement may be by means of a screw-nut system allowing to bring said thrust close to, or to separate same from, the return 37 of the horizontal opening 17.

The first two embodiments related to the adjustment of the articulation means being part of the fixed base 6. It can perfectly be conceived that the movable member 7 comprises means for adjusting the catching area 38.

Figure 6:
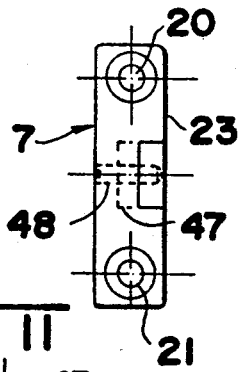
FIG. 6 is an elevation view of the movable member.
Figure 7:
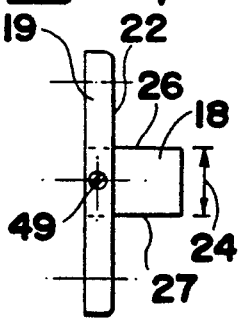
FIG. 7 is a left-hand view of the movable member.
Figure 8:
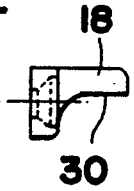
FIG. 8 is a bird's eye view of the movable member.

According to a third embodiment, which can be seen in dotted lines in FIGS. 6 and 7, for the adjustment, the position of the catching pin 18 can be changed. For this purpose, the catching pin can slide in a horizontal groove 47 in the front face 22 of the vertical base 19 of the movable member 7, under the action of a setting screw 48 also provided with seizing means 49 for a setting tool.

I claim:

1. Intermediate bearing for a door or window having a sash-frame and at least one leaf, which pivots about a vertical spindle, the sash-frame and the at least one leaf having stiles, and a means for articulation effecting cooperation between the stiles, said intermediate bearing comprising:

a movable member capable of being fastened to the leaf, said movable member having a catching pin;

a fixed base capable of attachment to the sash-frame, said fixed base including an opening in which said catching pin is capable of engaging; and adjustable articulation means for changing, perpendicularly to the stile of the sash-frame, a catching area between said catching pin and said fixed base, so as to permit adjustment of force applied to said catching pin by said fixed base so as to enable change of compressive force between the leaf and the stile of the sash-frame.

2. The intermediate bearing according to claim 1, wherein said catching pin includes an active face, and said adjustable articulation means include an articulation spindle housed in a vertical bore in said fixed base and cooperating with said active face of said catching pin.

3. The intermediate bearing according to claim 2, wherein said vertical bore ends in a narrowed bore having a shoulder, said articulation spindle including an enlarged portion which rests against said shoulder.

4. The intermediate bearing according to claim 1, wherein said adjustable articulation means is positioned in said movable member.

5. The intermediate bearing according to claim 4, wherein said movable member includes a vertical base having a horizontal groove in which said catching pin is movable by action of a setting screw.

6. The intermediate bearing according to claim 1, wherein said fixed base includes a vertical bore, and said adjustable articulation means include an articulation spindle positioned in said vertical bore, said movable member comprising a vertical base including a horizontal groove in which said catching pin is movable by action of a setting screw, and each of said articulation spindle and said setting screw comprising seizing means for a setting tool.

7. The intermediate bearing according to claim 1, wherein said fixed base includes a vertical bore, and said adjustable articulation means include an articulation spindle positioned in said vertical bore, said articulation spindle including an eccentric rotatable over 180 degrees between two extreme positions to obtain the changing of said catching area.

8. The intermediate bearing according to claim 1, wherein said adjustable articulation means is positioned within said fixed base.

9. In combination, a sash-frame and at least one leaf pivoting about a vertical spindle, and an intermediate bearing;

said sash-frame and said at least one leaf each including a stile, and means for articulation for effecting cooperation between the stiles; and said intermediate bearing comprising:

a movable member capable of being fastened to the leaf, said movable member having a catching pin;

a fixed base capable of attachment to the sash-frame, said fixed base including an opening in which said catching pin is capable of engaging; and adjustable articulation means for changing, perpendicularly to the stile of the sash-frame, a catching area between said catching pin and said fixed base, so as to permit adjustment of force applied to said catching pin by said fixed base so as to enable change of compressive force between the stile of the leaf and the stile of the sash-frame.

10. The combination according to claim 9, wherein said catching pin includes an active face, and said adjustable articulation means include an articulation spindle housed in a vertical bore in said fixed base and cooperating with said active face of said catching pin.

11. The combination according to claim 10, wherein said vertical bore ends in a narrowed bore having a shoulder, said articulation spindle including an enlarged portion which rests against said shoulder.

12. The combination according to claim 9, wherein said adjustable articulation means is positioned within said fixed base.

13. The combination according to claim 9, wherein said adjustable articulation means is positioned in said movable member.

14. The combination according to claim 13, wherein said movable member includes a vertical base having a horizontal groove in which said catching pin is movable by action of a setting screw.

15. The combination according to claim 9, wherein said fixed base includes a vertical bore, and said adjustable articulation means include an articulation spindle positioned in said vertical bore, said articulation spindle including an eccentric rotatable over 180 degrees between two extreme positions to obtain the changing of said catching area.

16. The combination according to claim 9, wherein said fixed base includes a vertical bore, and said adjustable articulation means include an articulation spindle positioned in said vertical bore, said movable member comprising a vertical base including a horizontal groove in which said catching pin is movable by action of a setting screw, and each of said articulation spindle and said setting screw comprising seizing means for a setting tool.

17. Intermediate bearing for a door or window having a sash-frame and at least one leaf, which pivots about a vertical spindle, the sash-frame and the at least one leaf having stiles, and a means for articulation effecting cooperation between the stiles, said intermediate bearing comprising:

a movable member capable of being fastened to the leaf, said movable member having a catching pin, and including a vertical base having a horizontal groove in which said catching pin is movable by action of a setting screw;

a fixed base capable of attachment to the sash-frame, said fixed base including an opening in which said catching pin is capable of engaging; and adjustable articulation means for changing, perpendicularly to the stile of the sash-frame, a catching area between said catching pin and said fixed base, so as to permit adjustment of compressive force, and said adjustable articulation means is positioned in said movable member.

18. Intermediate bearing for a door or window having a sash-frame and at least one leaf, which pivots about a vertical spindle, the sash-frame and the at least one leaf having stiles, and a means for articulation effecting cooperation between the stiles, said intermediate bearing comprising:

a movable member capable of being fastened to the leaf, said movable member having a catching pin, and including a vertical base including a horizontal groove in which said catching pin is movable by action of a setting screw;

a fixed base capable of attachment to the sash-frame, said fixed base including an opening in which said catching pin is capable of engaging, and said fixed base includes a vertical bore; and adjustable articulation means for changing, perpendicularly to the stile of the sash-frame, a catching area between said catching pin and said fixed base, so as to permit adjustment of compressive force, and said adjustable articulation means include an articulation spindle positioned in said vertical bore, and each of said articulation spindle and said setting screw comprise seizing means for a setting tool.

19. Intermediate bearing for a door or window having a sash-frame and at least one leaf, which pivots about a vertical spindle, the sash-frame and the at least one leaf having stiles, and a means for articulation effecting cooperation between the stiles, said intermediate bearing comprising:

a movable member capable of being fastened to the leaf, said movable member having a catching pin which includes an active face;

a fixed base capable of attachment to the sash-frame, said fixed base including an opening in which said catching pin is capable of engaging; and adjustable articulation means for changing, perpendicularly to the stile of the sash-frame, a catching area between said catching pin and said fixed base, so as to permit adjustment of compressive force, said adjustable articulation means include an articulation spindle housed in a vertical bore in said fixed base and cooperating with said active face of said catching pin, said vertical bore ends in a narrowed bore having a shoulder, said articulation spindle including an enlarged portion which rests against said shoulder.

20. In combination, a sash-frame and at least one leaf pivoting about a vertical spindle, and an intermediate bearing;

said sash-frame and said at least one leaf each including a stile, and means for articulation for effecting cooperation between the stiles; and said intermediate bearing comprising:

a movable member capable of being fastened to the leaf, said movable member having a catching pin, and said movable member includes a vertical base having a horizontal groove in which said catching pin is movable by action of a setting screw;

a fixed base capable of attachment to the sash-frame, said fixed base including an opening in which said catching pin is capable of engaging; and adjustable articulation means for changing, perpendicularly to the stile of the sash-frame, a catching area between said catching pin and said fixed base, so as to permit adjustment of compressive force, said adjustable articulation means being positioned in said movable member.

21. In combination, a sash-frame and at least one leaf pivoting about a vertical spindle, and an intermediate bearing;

said sash-frame and said at least one leaf each including a stile, and means for articulation for effecting cooperation between the stiles; and said intermediate bearing comprising:

a movable member capable of being fastened to the leaf, said movable member having a catching pin;

a fixed base capable of attachment to the sash-frame, said fixed base including an opening in which said catching pin is capable of engaging and a vertical bore; and adjustable articulation means for changing, perpendicularly to the stile of the sash-frame, a catching area between said catching pin and said fixed base, so as to permit adjustment of compressive force, and said adjustable articulation means include an articulation spindle positioned in said vertical bore, said movable member comprising a vertical base including a horizontal groove in which said catching pin is movable by action of a setting screw, and each of said articulation spindle and said setting screw comprising seizing means for a setting tool.

22. In combination, a sash-frame and at least one leaf pivoting about a vertical spindle, and an intermediate bearing;

said sash-frame and said at least one leaf each including a stile, and means for articulation for effecting cooperation between the stiles; and said intermediate bearing comprising:

a movable member capable of being fastened to the leaf, said movable member having a catching pin including an active face;

a fixed base capable of attachment to the sash-frame, said fixed base including an opening in which said catching pin is capable of engaging; and adjustable articulation means for changing, perpendicularly to the stile of the sash-frame, a catching area between said catching pin and said fixed base, so as to permit adjustment of compressive force, said adjustable articulation means include an articulation spindle housed in a vertical bore in said fixed base and cooperating with said active face of said catching pin, and said vertical bore ends in a narrowed bore having a shoulder, said articulation spindle including an enlarged portion which rests against said shoulder.

* * * * *